United States Patent [19]

Camardella

[11] 4,207,927

[45] Jun. 17, 1980

[54] BRAIDING DEVICE FOR COIL WINDING MACHINES

[75] Inventor: Giuseppe Camardella, Saronno,, Italy

[73] Assignee: Tekma Kinomat S.p.A., Caronno Pertusella, Italy

[21] Appl. No.: 913,077

[22] Filed: Jun. 6, 1978

[30] Foreign Application Priority Data

Jun. 9, 1977 [IT] Italy ..... 24518 A/77

[51] Int. Cl.[2] ..... B21F 3/00; B21F 7/00

[52] U.S. Cl. ..... 140/102; 140/149

[58] Field of Search ..... 140/92.1, 92.2, 102, 140/115, 119, 124, 149; 28/289; 242/50, 61

[56] References Cited

U.S. PATENT DOCUMENTS

| | | | |
|---|---|---|---|
| 664,326 | 12/1900 | Kintzing | 140/115 |
| 3,362,440 | 1/1968 | Meile et al. | 140/149 |
| 3,804,131 | 4/1974 | Holmes et al. | 140/92.2 |
| 4,129,158 | 12/1978 | Schmid | 140/149 |

*Primary Examiner*—Ervin M. Combs

*Attorney, Agent, or Firm*—Young & Thompson

[57] ABSTRACT

A braiding device for intermittently forming a wire braid from a single wire fed without interruption, of the type in which seizing means seize the wire at an intermediate point along its length and make a movement such as to form a double wire loop combined with a straight portion of the wire to then undergo twisting, has seizing means rigid with a circular sector moved with reciprocating rolling movement along a straight guide, so as to describe a cycloid trajectory.

15 Claims, 9 Drawing Figures

BRAIDING DEVICE FOR COIL WINDING MACHINES

BACKGROUND OF THE INVENTION

This invention relates to a braiding device for application particularly in coil winding machines.

When a coil or spool of very thin metal wire is made, it is advisable to construct a braid at the ends of the winding, or to fit one thereto, in order to reinforce said ends and make them resistant to handling, for example when welding the ends to terminals, when taping the coil, when packing or the like.

In the oldest method, braids were constructed separately from the coil winding and then soft-soldered to the coil ends. In such a case it could happen that the solder flux contained traces of chlorides, which were able sooner or later to lead to a discontinuity in the winding. It was also necessary to isolate the soldered joint and braid from the winding with adhesive tape, the adhesive of which had to have absolutely non-corrosive properties.

For this reason, braiding devices have been used for some time for forming braids intermittently from the same single wire which forms the winding. These braids are always formed from an odd number of single wires, which are grouped parallel to each other by the combined action of hooks which are moved with reciprocating motion, or which are connected to endless chains. When the single wires have been formed into a parallel group, an additional element operates by rotation to twist the group.

In those machines, and in particular in turret coil winding machines, in which the winding wire is fed practically continuously, it is necessary for these braiding devices to be very fast. This is because as they have to obviously operate with the wire at rest (i.e. with the winding head not drawing wire), the braiding time is added to the winding time, so reducing the productivity of the machine.

SUMMARY OF THE INVENTION

The main object of the present invention is therefore to provide a braiding device which is firstly able to operate on a continuous single wire, i.e. without having to interrupt it, and which combines high operational speed with constructional and operational simplicity.

A further object of the invention is to provide a device which is of minimum bulk, but which is able to form a braid of considerable length.

A further object of the invention is to provide a device able to form braids with any odd number of single wires by simply repeating the grouping of the single wires.

A further object of the invention is to provide an essentially "open" braiding device, i.e. which enables a continuous wire to be inserted into it by simply bringing it alongside the horizontal line represented by the device by means of a transverse movement, preferably from the top downwards.

The device according to the present invention is of the general type in which seizing means seize the single wire at an intermediate point along its length and make a movement such as to form a double wire loop which is then combined with a straight portion of the single feed wire. It is characterised essentially in that said seizing means are rigid with a circular sector moved with a reciprocating rolling movement along a straight guide, so as to describe a cycloid trajectory.

Preferably, said circular sector is a toothed sector extending through an angle greater than or at least equal to 180°, which rolls on a straight rack, and said wire seizing means are carried at the end of an arm rigid with said sector and projecting therefrom along its median axis of symmetry.

According to a further characteristic of the invention, the position of said arm carrying the wire seizing means is adjustable in order to adjust the distance of said seizing means from the centre of the sector.

Finally, a further important aspect of the invention is that all the working elements of the braiding device are disposed in a horizontal line and open upwards to receive the wires to be braided, which are inserted with a transverse movement so that they become disposed along said line, between said elements there being included a wire twisting grip rotatably mounted about a fixed axis which coincides with said line.

Further characteristics and advantages of the present invention will be apparent from the description given hereinafter, by way of example only, of a preferred embodiment thereof.

DESCRIPTION OF THE PREFERRED EMBODIMENTS

Figure 1:
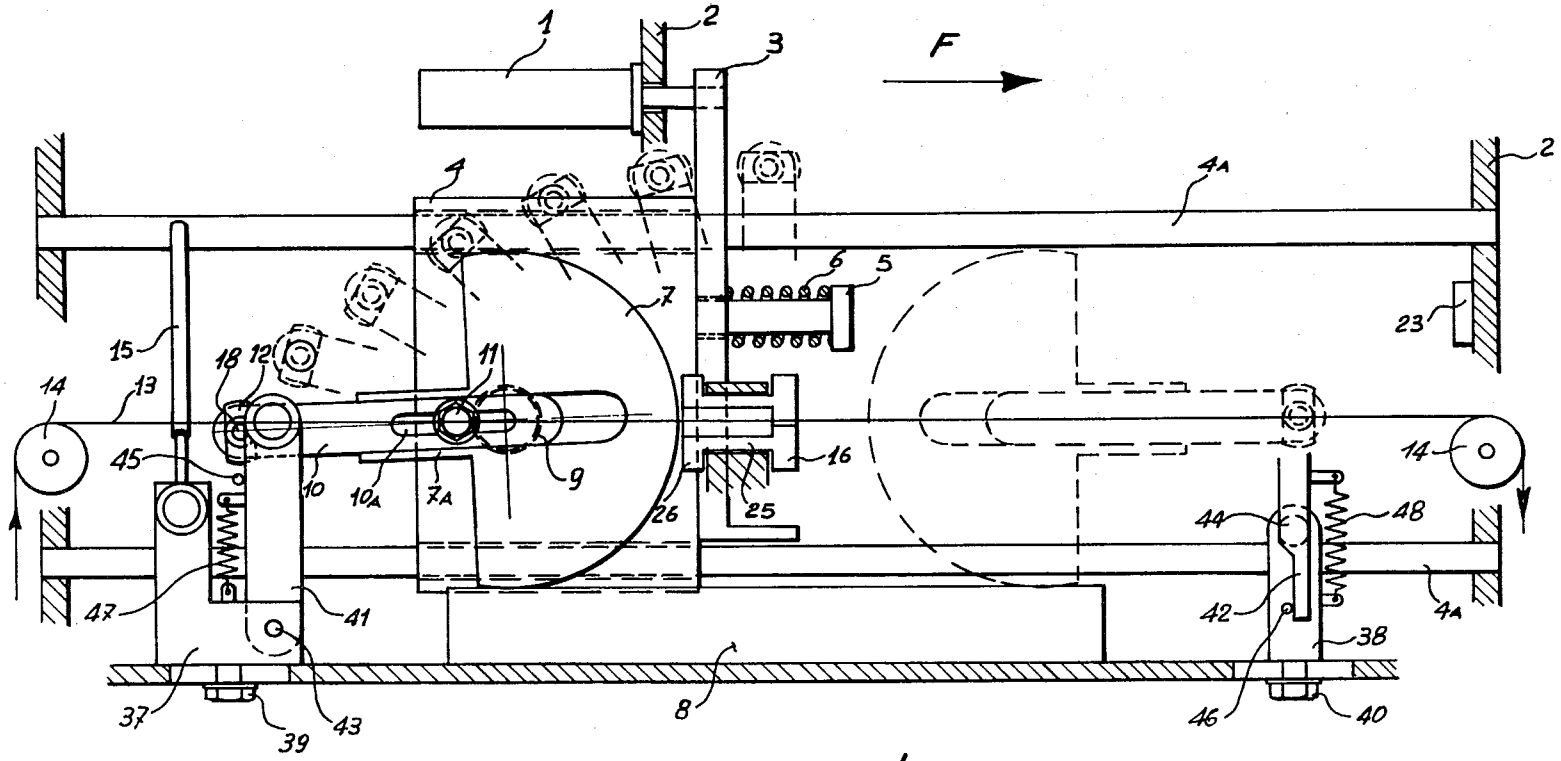
FIGS. 1 and 2 are diagrammatic partial side and plan views respectively of the braiding device according to the invention.
Figure 2:
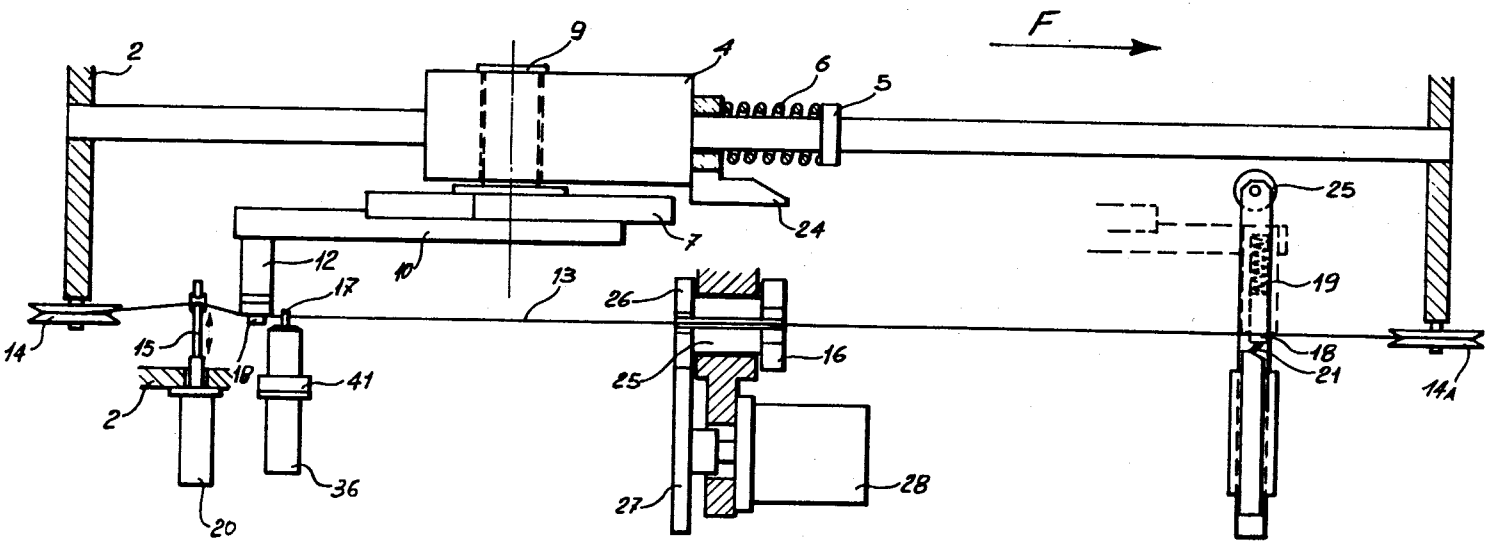

As shown in FIGS. 1 and 2, the pneumatic cylinder 1, which is fixed to the fixed machine structure 2, has the end of its piston rod connected to the plate 3. This latter is connected to the carriage 4 by the screw 5 and with the interposition of the spring 6. The spring 6 allows a certain relative axial movement between the plate 3 and carriage 4, for the purpose stated hereinafter.

Thus the forward-return stroke of the rod of the cylinder 1 produces a corresponding forward-return movement of the carriage 4 along its axial guides 4A.

The toothed sector 7, which engages with the rack 8, is connected to the carriage 4 by the pin 9 (see FIG. 2), about which it can rotate freely.

A groove directed along the median axis of the sector 7 is obtained in the lateral surface of the sector 7 and in a radial extension 7A thereof, to receive the arm 10, which is fixed therein by a screw 11 and carries mounted on its end the head 12 constituting the wire seizing means.

The arm 10 is adjustable in position relative to the sector 7, by means of the slot 10A in which the screw 11 is engaged. This adjustment enables the position of the head 12 relative to the centre of the sector to be changed, for the purpose stated hereinafter.

The head 12 carries a small roller 18, which is free to rotate about its axis and is sprung axially. It projects outwards from the head 12 by a short portion of its length, urged by the spring 19 (illustrated by dashed lines on the right hand side of FIG. 2).

The wire 13, which is the same wire as that used for winding the coil (not shown), is stretched between the pulleys 14 and 14*a* and passes through the fork 15 and centrifugal grip 16, which are both open upwards, and over the small roller 18 and under the pin 17.

The fork 15, which in FIG. 2 is shown completely forward having been thrust by the pneumatic cylinder 20, deviates the wire 13 to ensure that it rests against the flat front of the head 12, so that it safely remains on the small roller 18 and under the pin 17.

When the pneumatic cylinder 1 begins its stroke in the direction of the arrow F from the position shown in FIGS. 1 and 2, it thrusts the plate 3, and this latter moves the carriage 4 forward by way of the spring 6 and screw 5.

The toothed sector 7 then rotates about the pin 9, and is compelled to roll on the rack 8, so that the head 12 mounted on the end of the arm 10 describes a cycloid trajectory (see the successive positions shown by dashed lines in FIG. 1), and moves towards the right hand end (relative to the drawing), so assuming the position indicated by dashed-lines in FIG. 1.

Figure 3:
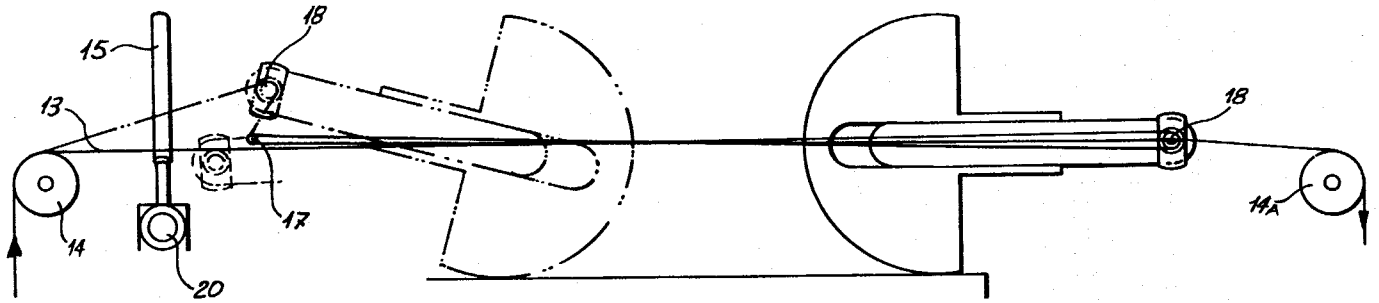
FIGS. 3, 4 and 5 are side, plan and perspective views respectively showing the operation of said device.

As the wire 13 is on the small roller 18, it is seized at the beginning of this movement in the manner shown by the lines consisting of dashes and two dots on the left hand side of FIG. 3. In this manner, a double wire loop is formed, which is gradually extended and brought towards the right of the drawing, following the small roller 18 in its cycloid trajectory, until it becomes disposed parallel to the line represented by the single wire 13 running between the pulleys 14 and 14*a*.

It is important to note that the double wire loop is able to be brought alongside the horizontal line represented by the single wire 13, by a practically transverse approach movement, because of the structural characteristic of the device according to the invention, in which all the working elements are open upwards. As can be easily seen, in addition to the pulleys 14 and 14*a*, also the fork 15, the small roller 18 and the twisting grip 16 (described hereinafter) are all configured in such a manner that the wire does not need to be inserted by means of an axial movement (which is always relatively complicated, as has been found in the case of machines of the known art), but simply by bringing it alongside with a transverse movement. This has not only the advantage of simplifying the movement of formation of the double wire loop, as seen heretofore, but also of making it simple to transversely insert the main single wire 13 itself. The result of this is that the device according to the invention can be used as a single braiding unit for braiding several groups of wires in succession, for example in a turret coil winding machine, or in a transfer coil winding machine with several winding heads. In other words, the braiding device according to the invention can serve several winding heads in succession, which up to the present time the known art has not managed to effect.

Figure 4:
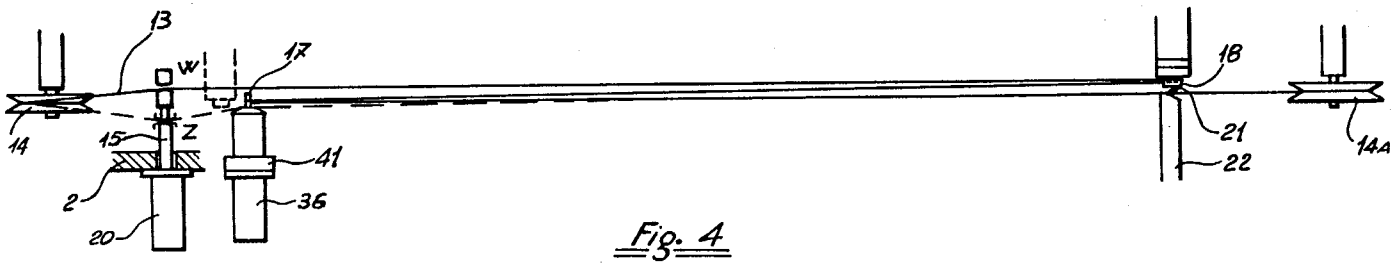

At the end of the stroke of the carriage 4, the small roller 18 is in front of the pin 21, which projects obliquely from the support 22 (FIG. 4). The carriage 4 stops in a position which is exactly set, and corresponding to the halting of the head 12, or rather of the small roller 18, precisely in front of the pin 21, thanks to the striking of the screw 5 against the fixed stop 23 rigid with the machine support structure 2 (see FIG. 1).

However, the plate 3, thrust by the cylinder 1, travels through a further short distance after the stoppage of the carriage 4, by compressing the spring 6. Over this distance, the lower end 24 of the plate 3, which is of wedge shape, comes into cooperation with the wheel 25 carried by the support 22. By means of this cooperation, the inclined plane of the end 24 causes the support 22 to move in the direction of the arrow shown in FIGS. 6 and 7.

As a result of this movement, the pin 21 rests on the small roller 18 and thrusts it. This latter, reentering the cavity in the head 12, causes the wire 13 lying on it to become released, said wire being discharged on to the pin 21. During this stage, the head 12 thus acts as a wire expeller.

Figure 5:
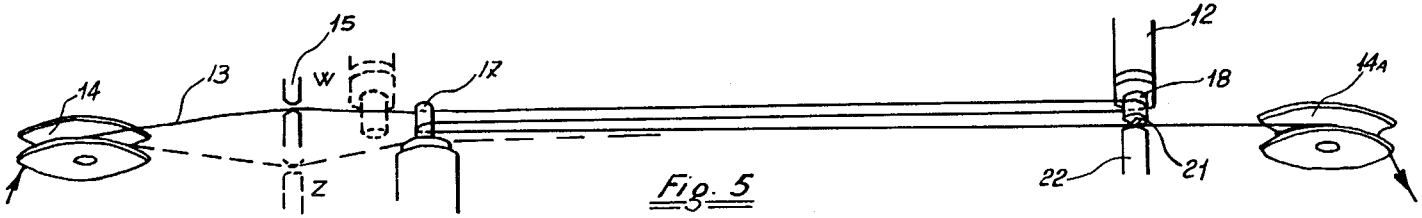
Figure 6:
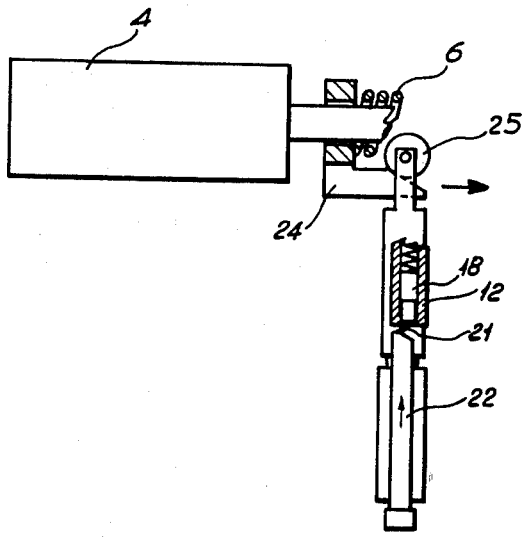
FIGS. 6 and 7 are diagrammatic plan and elevational views respectively, with parts sectioned, of the unit for unloading the loop of formed wire.
Figure 7:
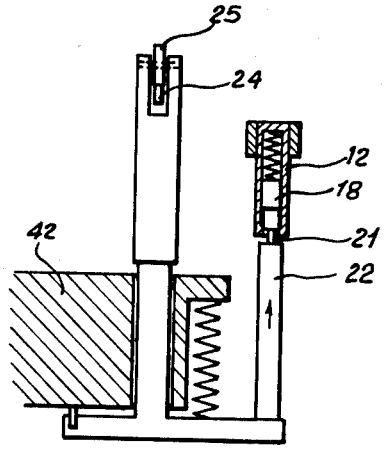

All the operations heretofore described are illustrated in FIGS. 6 and 7 with regard to the action of the support 22 and pin 21 in discharging the wire from the small roller 18 on to the pin 21, and in FIGS. 3, 4 and 5 with regard to the formation of the double wire loop and its parallel alignment with the portion of single wire running between the pulleys 14 and 14*a*.

When the cylinder 1 has finished its stroke and the wire loop has been discharged on to the pin 21, the cylinder 1 withdraws to return the plate 3 into its initial position. The small roller 18, free of the wire which remains hooked on to the pin 21, repeats the cycloid trajectory backwards, until it reaches its starting point.

The fork 15, which during the forward stroke of the cylinder 1 was kept in the forward position W (FIG. 4) to ensure that the wire was retained on the small roller 18, passes into its withdrawn position Z during the return stroke of the cylinder 1, under the control of the cylinder 20. In this manner, it ensures that the small roller 18 freely returns to its initial position. In fact, the wire 13—which during the first part of the forward stroke of the carriage 4 had lifted itself (as shown by the line consisting of dashes and two dots in FIG. 3), and during the second part of the same forward stroke had lowered itself up to falling below the level of the pin 17—moves away from the return trajectory of the small roller 18 as the fork 15 passes into the position Z (FIGS. 4 and 5).

When the return stroke is completed, the cylinder 20 again returns the fork 15 into its forward position W.

At this point, the wire 13 is deviated between the pins 17 and 21 to form a double loop, or a group of three ends.

The centrifugal grip 16 (shown in FIGS. 8 and 9), keyed on the hub 25, is disposed at the centre of the portion of wire between the pins 17 and 21, and coaxial to it, as shown in FIGS. 1 and 2. On the other end of the hub 25 there is keyed the gear wheel 26, which engages with the gear wheel 27, this latter keyed on to the shaft of the drive motor 28.

After the formation of the group of three ends of wire, i.e. after the carriage 4 has returned to its initial position a signal is released to start the motor 28, which rotates the centrifugal grip 16. This latter then twists the group of three ends of wire, i.e. forms the braid, as described hereinafter with reference to FIGS. 8 and 9.

Figure 8:
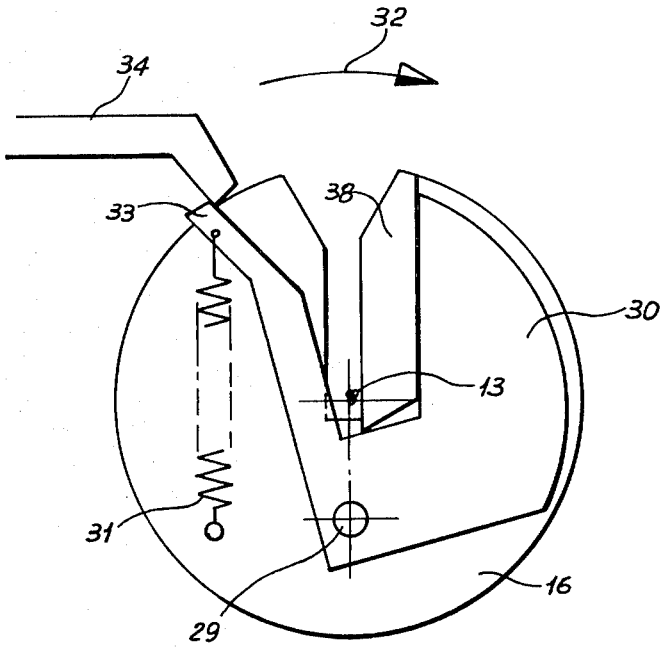
FIGS. 8 and 9 show the rotating twisting unit viewed in the direction of the braid axis, in the open and gripping position respectively.
Figure 9:
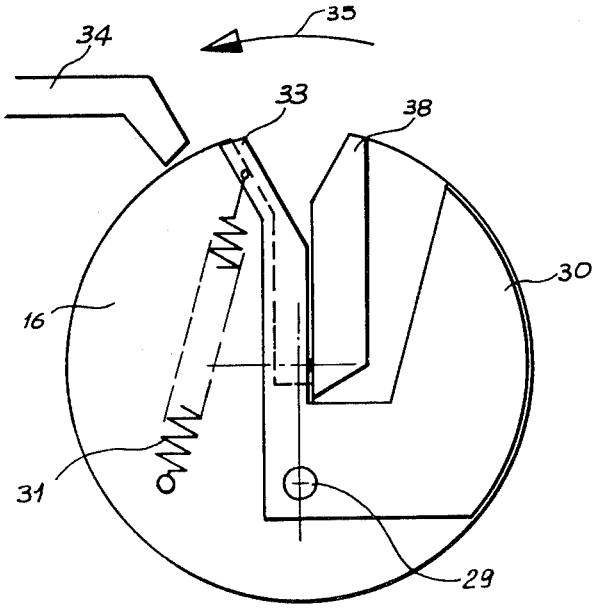

As can be seen in FIGS. 8 and 9, when in their rest position the three ends of wire 13 are approximately at the centre of a radial slot in the grip 16, which is open upwards. The open end of this slot is of V shape, to form a lead-in, to facilitate insertion of the wire, particularly at the moment when the loop of wire formed by the small roller 18 is grouped together with the wire stretched between the pulleys 14 and 14*a*.

The mobile part 30 of the grip, constituted essentially by an eccentric counterweight and maintained by the spring 31 in such a position that the grip is open, is pivoted on the eccentric pin 29 (FIG. 8).

During the operations described heretofore in relation to the formation of the group of three ends of wire, the grip remains in the position of FIG. 8 with the V aperture facing upwards. In fact, during this stage, a small voltage is supplied to the motor 28 to make it tend to rotate the grip in the direction of the arrow 32; however under these conditions the spring 31 maintains the beak 33 completely open and therefore projecting from the outer circumference of the grip. The beak 33 rests against the stop 34 and thus keeps the grip at rest.

When the said signal for operating the grip 16 is released, the motor 28 is rotated in the opposite direction, i.e. in the direction of the arrow 35 and at its normal operating voltage. The grip then rotates in the direction of the arrow 35 (FIG. 9).

As the rotational speed increases, the centrifugal force acting on the eccentric counterweight of the mobile part 30 overcomes the force of the spring 31 to close and clamp the wires against the counter-member 38 of the grip.

Under these conditions, the beak 33 has approached the centre of the grip, so that it no longer hinders the rotation of the grip (see FIG. 9).

After the three ends of wire have been twisted, a suitable signal, for example from an adjustable timer, reverses the supply current to the motor 28, so reproducing the conditions mentioned at the beginning. The grip thus rotates at low speed in the direction of the arrow 32, and the spring 31, which at this speed overcomes the action of the centrifugal force, again opens the beak 33 which halts against the stop 34, at its first passage.

As can be seen in FIG. 1, the pin 17 is mounted at the end of a swivel arm 41 rotatable about a pin 43 and urged by a spring 47 to rotate anti-clockwise, and resting against a stop 45. Symmetrically, the pin 21 and its support 22 are mounted at the end of a swivel arm 42 which is rotatable about a pin 44 and is urged by a spring 48 to rotate anticlockwise, and rests against a stop 46. Consequently, the two arms 41 and 42, and hence the relative pins 17 and 21, can spring one towards the other to enable the pins 17 and 21 to approach each other. This is necessary in order to compensate for the shortening of the group of three ends of wire, which necessarily occurs during the twisting stage.

In this manner, a particularly robust braid is obtained from the group of three parallel ends of wire, being perfectly rigid with the length of wire running between the two pulleys 14 and 14*a*.

This braid is now supported between the pins 17 and 21. When the pin 17 withdraws under the control of the cylinder 36, the braid is released from the pin 17, whereas it is released from the pin 21 automatically—also thanks to the obliqueness of the pin 21 itself—when a coil is again wound and the wire is pulled in the direction of the arrow F.

With the cycle heretofore described, a braid of three ends is obtained, and when winding re-commences said braid is pulled towards the coil where it forms the reinforced end or ends of the winding. However, by suitable programming it is possible to obtain a more robust braid, i.e. formed by a group not only of three ends but of any odd number of ends.

For this purpose, before starting rotation of the grip 16, it is sufficient to repeat the forward and return stroke of the pneumatic cylinder 1 a number of times equal to the number of further pairs of ends of wire to be combined with the first three.

A further advantage of the device according to the invention is the possibility of adjusting the length of the braid. In this respect, by adjusting both the position of the arm 10 along the radial groove in the sector 7 and the position of the supports 37 and 38 which carry the swivel arms 41 and 42 of the pins 17 and 21 respectively, the length of the portion of braided wire can be easily varied.

As can be seen in FIG. 1, the supports 37 and 38 are in fact adjustable in position along the grooves provided in the supporting structure 2, in which they are locked by the screws 39 and 40 respectively.

As heretofore stated, the main advantages of the device according to the invention can be summarised as follows:

possibility to obtain a long portion of braided wire by a mobile unit of minimum bulk, by utilising the cycloid trajectory;

especially smooth operation, because of the cycloid movement in which the initial and final speeds are zero, and in which the acceleration is progressive up to a maximum value, with progressive deceleration down to zero;

possibility to adjust the length of the braid;

possibility to adjust the operational speed (i.e. in practice the speed of the cylinder 1 and carriage 4) in accordance with the tensile strength of the wire to be braided;

possibility to braid a continuous wire because of the fact that all the elements which operate on the wire are open laterally, and the wire can gain access to them transversely to its length. This is an important advantage over devices of the known art, because in practice, as already stated, it enables a single braiding unit to be used for serving several winding heads in a multi-head coil winder;

possibility to use a twisting grip rotating about a fixed axis, because of the fact that the double wire loop enters the grip automatically, as seen, and therefore does not need to be aided by a special tool, the size of which would require the grip to be withdrawn and to be then repositioned on the wire to be braided, as happens normally in machines of the known art.

Although the invention has been described with specific reference to the illustrated embodiment, this latter has been given by way of example only, and is therefore subject to various modifications, all available to an expert of the art, and all of which fall within the scope of protection of the invention.

I claim:

1. In a braiding device for intermittently forming a wire braid from a single wire fed without interruption, of the type in which seizing means seize the wire at an intermediate point along its length and makes a movement such as to form a double wire loop, which is juxtaposed with a straight portion of the wire to then undergo twisting; the improvement comprising a straight guide that extends parallel to the wire, a circular sector that rolls back and forth along said straight guide, an arm rigid with said circular sector and projecting from said circular sector along the median axis of symmetry of said circular sector, seizing means for said wire carried at the end of the arm opposite said circular sector, and means for rolling said sector back and forth along said straight guide to move said seizing means in a cycloidal trajectory that retraces its own path in opposite directions as said circular sector rolls back and forth on said straight guide to thereby form said double wire loop.

2. A device as claimed in claim 1, said circular sector being a toothed sector extending through an angle exceeding 180°, said straight guide being a toothed rack with which said toothed sector meshes.

3. A device as claimed in claim 1, and means for varying the distance of said seizing means from the center of curvature of said circular sector along said median axis of the sector, thereby to vary the length of said cycloidal trajectory.

4. A device as claimed in claim 1, said seizing means comprising a cylindrical head, a small roller projecting from said cylindrical head and being freely rotatable about its axis, said small roller being retractable inside said head, and spring means yieldably urging said small roller axially out of said head.

5. A device as claimed in claim 4, in which said small roller and cylindrical head are coaxial and their common axis is perpendicular to the length of the wire.

6. A device as claimed in claim 1, and first and second wire retention means at the initial and final ends of said cycloid trajectory, and means mounting said retention means at the ends of arms which in turn are mounted for swivelling movement in the direction of the wire length.

7. A device as claimed in claim 6, said swivel arms being pivoted on supports, and means mounting said supports displaceably for movement parallel to the wire length and for adjusting said supports in any of a plurality of moved positions.

8. A device as claimed in claim 6, said first wire retention means comprising a pin which projects axially from a seat and which can withdraw into said seat in order to discharge the wire braid formed.

9. A device as claimed in claim 6, in which said second wire retention means comprises a pin carried by a support, means mounting said support for movement transversely to the wire length and so positioned as to coact with said seizing means to cause the wire on said seizing means to be discharged onto said second wire retention means.

10. A device as claimed in claim 1, and a twisting apparatus intermediate the ends of said cycloid trajectory, said twisting apparatus comprising a grip for gripping a group of adjacent wires, and means for rotating said grip about an axis parallel to said wires.

11. A device as claimed in claim 10, said twisting apparatus comprising a disc with a radial slot which terminates in a flared mouth, and a counter weight pivoted eccentrically on said disc and comprising an extension arm so positioned as to clamp the group of wires against the edge of said slot upon rotation of the disc about the axis of the disc.

12. A device as claimed in claim 11, and a motor for rotating said disc, and spring means against which said counterweight swings under the influence of centrifugal force.

13. A device as claimed in claim 12, said counter weight having an extension arm thereon which projects from the periphery of the disc when the disc is at rest, to constitute a stop tooth for the disc.

14. A device as claimed in claim 1, in which all the elements that contact the wire are disposed along the line of said single wire fed without interruption, and all open laterally in the same direction to receive the wire without threading.

15. A device as claimed in claim 14, and a twisting apparatus disposed intermediate the ends of said cycloid trajectory, and means for rotating said twisting apparatus about the axis of the wire, said twisting apparatus in a rest position thereof also opening laterally in the same direction as the other said elements.

* * * * *